United States Patent [19]

Colombo et al.

[11] 4,192,738

[45] Mar. 11, 1980

[54] PROCESS FOR SCAVENGING IRON FROM TAILINGS PRODUCED BY FLOTATION BENEFICIATION AND FOR INCREASING IRON ORE RECOVERY

[75] Inventors: Arthur F. Colombo; David M. Hopstock, both of Twin Cities, Minn.

[73] Assignee: The United States of America as represented by the Secretary of the Interior, Washington, D.C.

[21] Appl. No.: 953,395

[22] Filed: Oct. 23, 1978

[51] Int. Cl.[2] ..... B03B 1/00

[52] U.S. Cl. ..... 209/5; 209/39; 209/166

[58] Field of Search ..... 209/166, 167, 39, 219, 209/214.5; 241/20; 423/80, 151, 152

[56] References Cited

U.S. PATENT DOCUMENTS

| | | | |
|---|---|---|---|
| 2,088,364 | 7/1937 | Ellis | 209/219 X |
| 2,352,324 | 6/1944 | Hubler | 209/39 X |
| 2,388,471 | 11/1945 | DeVaney | 209/39 |
| 2,875,896 | 3/1959 | Last | 209/166 |
| 3,273,707 | 9/1966 | Maltby | 209/39 |
| 3,292,780 | 12/1966 | Frommer | 209/5 |
| 3,375,925 | 4/1968 | Carpenter | 209/214 |
| 3,502,271 | 3/1970 | Hays | 241/20 |
| 3,920,543 | 11/1975 | Marston | 209/222 |
| 4,113,466 | 9/1978 | Weston | 209/39 X |

FOREIGN PATENT DOCUMENTS

| | | | |
|---|---|---|---|
| 130238 | 12/1950 | Sweden | 209/166 |

*Primary Examiner*—Robert Halper

*Attorney, Agent, or Firm*—William S. Brown; Donald A. Gardiner

[57] ABSTRACT

There is disclosed a process for scavenging iron from tailings produced by the flotation beneficiation of iron ore. This process includes the step of scavenging the flotation tailings using wet high-intensity magnetic separation (WHIMS). There is also disclosed a process for increasing the recovery of iron ore in a flotation beneficiation process. This iron ore recovery process includes the steps of feeding the magnetic concentrate produced by the scavenging process to a flotation system and then carrying out an additional flotation step.

15 Claims, 2 Drawing Figures

PROCESS FOR SCAVENGING IRON FROM TAILINGS PRODUCED BY FLOTATION BENEFICIATION AND FOR INCREASING IRON ORE RECOVERY

This invention relates to a process for scavenging iron from tailings produced by flotation beneficiation of iron ore, and relates to using the product of the iron scavenging process for increasing iron ore recovery.

BACKGROUND ART

It is known in unrelated art to use magnetic filtration to remove certain impurities from kaolin slurries. J. Iannicelli, "High Extraction Magnetic Filtration of Kaolin Clay", Preprint 76-H-7, AIME Annual Meeting, Las Vegas, Nev., Feb. 22–26, 1976, pp. 16, discloses the use of high extraction magnetic filtration to remove iron-stained anatase and quartz, hematite, mica, tourmaline, siderite and pyrite from kaolin.

In related art, it is known to use a continuous carousel high-gradient separator to produce a feed for a flotation pilot plant in which flotation is used to produce the final iron oxide concentrate, and furthermore, it is known to use this type of separator for producing high grade iron oxide concentrates. See D. R. Kelland and E. M. Maxwell, "Oxidized Taconite Beneficiation by Continuous High Gradient Separation", IEEE Trans. on Magnetics, Vol. MAG-11, No. 5, September 1975, pp. 1582–1584, and D. R. Kelland, "High Gradient Magnetic Separation Applied to Mineral Beneficiation", IEEE Trans. on Magnetics, Vol. MAG-9, No. 3, September 1973, pp. 307–310, respectively.

Additionally, it is known to use wet high-intensity magnetic separation as a preconcentrating step in the beneficiation of low-grade iron ore material. Exemplary of this type of prior art are U.S. Pat. No. 3,337,328 to Lawver and U.S. Pat. No. 3,502,271 to Hays. These patents require the use of magnetic separation prior to a flotation step.

Another patent of interest is U.S. Pat. No. 2,352,324 to Hubler which discloses an ore beneficiation process which uses a flotation step and a type of magnetic separation that requires conditioning weakly magnetic impurities with an inorganic reagent.

None of the prior art of which we are aware discloses a process for scavenging iron from tailings produced by flotation beneficiation of iron ore, in which wet high-intensity magnetic separation (WHIMS) is used for scavenging and in which this scavenging step is the first treatment of the iron ore with a magnetic separator. Furthermore, none of the prior art of which we are aware discloses a process that can be used to increase the iron recovery in operating and future flotation beneficiation plants and that will permit these plants to yield a more uniform output by leveling off the variations in the flotation process due to changes in ore characteristics.

DISCLOSURE OF THE INVENTION

It is accordingly one object of the present invention to provide a process for scavenging iron from tailings produced by the flotation beneficiation of iron ore, in which the scavenging is carried out by use of a wet high-intensity magnetic separator.

A further object of the present invention is a process that can be used to increase the iron recovery in operating and future flotation beneficiation plants.

An even further subject is to permit flotation beneficiation plants to yield a more uniform output by leveling off the variations in the flotation process due to changes in ore characteristics.

Other objects and advantages of the present invention will become apparent as the description thereof proceeds.

In satisfaction of the foregoing objects and advantages, there is provided by this invention a process for scavenging iron from tailings produced by the flotation beneficiation of iron ore. This process includes the step of scavenging flotation tailings with a wet high-intensity magnetic separator, whereby there is obtained a magnetic concentrate and whereby the tailings are reduced in iron content. This scavenging step is the first treatment of the iron ore with a magnetic separator. There is also provided by the present invention, a process for increasing the recovery of iron ore in a flotation beneficiation process. This process includes the steps of feeding the magnetic concentrate produced by the iron scavenging process to a flotation system and then carrying out additional flotation in the flotation system, whereby the recovery of iron ore is increased. Prior to being fed to the flotation system, the magnetic concentrate is fed to a thickener to increase the solids content of the concentrate. The thickening step, although usually desirable, is not essential.

BRIEF DESCRIPTION OF THE DRAWINGS

Reference is hereby made to the accompanying drawings which form a part of the specification of the present invention.

BEST MODE FOR CARRYING OUT THE INVENTION

Figure 1:
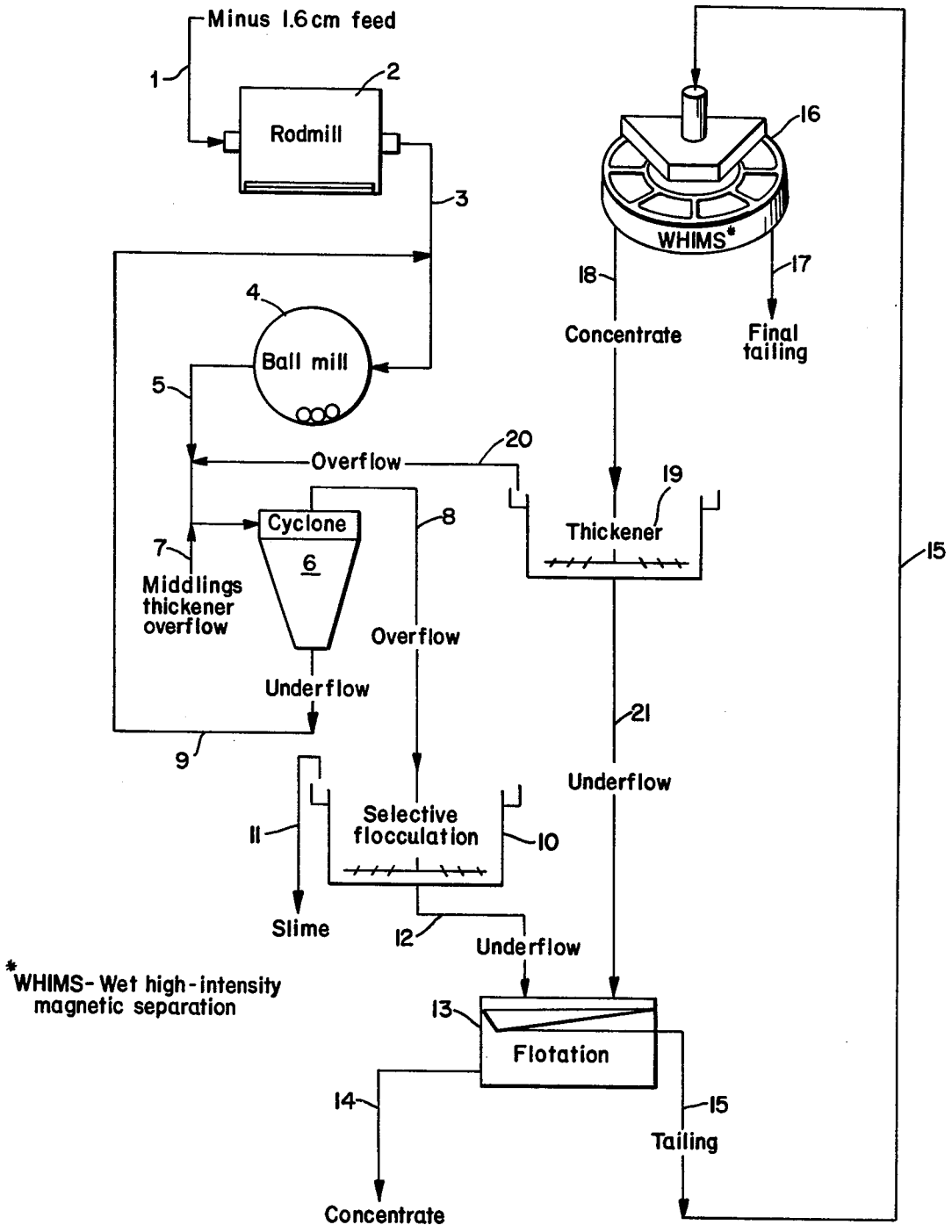
FIG. 1 depicts the present invention as part of an overall ore flotation beneficiation process.

As indicated above, the present invention is concerned with a process for scavenging iron from tailings produced by the flotation beneficiation of iron ore, and further is concerned with a process for using the product produced by the scavenging process to increase iron ore recovery. According to the present invention, the iron scavenging process includes the step of treating flotation tailings with a wet high-intensity magnetic separator to produce, as the product, a magnetic concentrate, and as the by-product, tailings that are reduced in iron content. Also, according to the present invention, the magnetic concentrate produced by this process is fed to a flotation system to increase iron ore recovery.

The iron scavenging process of the present invention includes the essential step of feeding flotation tailings to a wet high-intensity magnetic separator. The magnetic separator produces a magnetic concentrate as the product and also produces a nonmagnetic tailing. This tailing has a lower iron content than the tailing used as a starting material in this process. This scavenging step is the first treatment of the iron ore with a magnetic separator.

Suitable magnetic separators for use in the present process may have a ferromagnetic matrix. Exemplary of this type of separator are a high-gradient carousel-type separator such as is manufactured by Sala Magnetics, Inc., of Cambridge, Mass., a cyclic high-intensity separator, and a rotor high-intensity separator such as the Jones DP317 and DP 335 wet high-intensity magnetic separators manufactured by KGD Industrieanlagen AG. The carousel-type separator may be used with particular advantage. The ferromagnetic matrix media of these separators acts to collect the weakly paramagnetic iron oxide particles. Exemplary ferromagnetic matrices are stainless steel wool, expanded metal, screens, balls, and grooved plates. In addition to this type of separator, there may also be used wet high-intensity magnetic separators that do not have a ferromagnetic matrix.

The magnetic separator is operated so as to produce an air-gap magnetic field strength that is suitably in the range of from about 2 kG to about 100 kG, with about 5 kG to 10 kG being preferred for use with a ferromagnetic matrix. Selection of the magnetic field strength is dependent upon the type of iron-bearing material that is being treated. The orientation of the magnetic field is suitably either transverse or parallel to the direction of slurry flow. Other details concerning the operation of this separator are found, for example, in the publications to Kelland and Maxwell and to Kelland, the disclosures of which are hereby incorporated by reference.

The tailings that are used in the present process are produced by a conventional iron ore flotation beneficiation process. Suitable tailings are those obtained at the Tilden Mine in Michigan.

The flotation system in conventional iron ore flotation beneficiation processes is made up, for example, of rougher, cleaner and scavenger cells. Exemplary types of flotation used in this type of system are cationic gangue flotation, anionic activated gangue flotation and anionic iron oxide flotation, with cationic gangue flotation being particularly suitable for producing tailings useful in the present invention. When cationic gangue flotation is used, it is advantageous to precede the flotation by a selective flocculation step. Since this type of flotation system, these types of flotation and selective flocculation are generally well known in this art area, further disclosure thereof is not provided herein.

Optionally, the present process includes the further step of feeding the nonmagnetic tailings from the magnetic separation step to another, or to another separation zone of the same, wet high-intensity magnetic separator, for further scavenging. This additional scavenging step produces tailings that are further reduced in iron content. The wet high-intensity magnetic separator used in this step is operated in the manner disclosed above.

As another optional step of the present process, the magnetic concentrate from the magnetic separation step is fed to another separation zone of the same, or to another, wet high-intensity magnetic separator. This particular step is used to produce a magnetic concentrate of higher grade than the feed magnetic concentrate. A higher grade concentrate is one that contains a greater percentage of iron. The wet high-intensity magnetic separator used in this step is operated in the manner set forth above.

As will be understood by one skilled in this art, the rescavenged tailings could be further scavenged and the higher grade magnetic concentrate could be further increased in grade by using additional wet high-intensity magnetic separation (WHIMS). Various products could be combined and middlings products could be recycled.

The present invention also provides a process for increasing the recovery of iron ore in a flotation beneficiation process. In the first essential step of this iron ore recovery process, the magnetic concentrate is fed to rougher, cleaner or scavenger cells of the original or a different flotation system. Advantageously, the concentrate is fed to the original flotation system. The type of flotation used in this step is suitably any of the types described earlier, with cationic gangue flotation being particularly suitable.

Prior to flotation of the magnetic concentrate, the concentrate is optionally fed to a thickener in order to increase the solids content thereof. Generally, no chemicals are added to the thickener. This type of step is well known in the art, as illustrated by the patent to Hays, the disclosure of which, at col. 4, lines 10–12, is hereby incorporated by reference into this application. The thickener underflow is fed to flotation system, and the thickener overflow is alternatively fed to a cyclone used for classifying milled feed ore prior to the initial flotation step, fed to the magnetic separator as concentrate flush water, routed to a water treatment circuit used in the beneficiation process, or discarded in a tailing pond. In the event that the particles in the thickened concentrate are locked, it may be desirable that the particles be ground to liberation prior to being fed to the flotation system.

The result of this process is an increase in the recovery of iron ore.

Reference is now made to FIG. 1 accompanying the application which exemplifies an overall metallurgical process for conducting the process of this invention in combination with other steps to obtain the tailings starting material. In this drawing, the feed, which is preferably of minus 1.6 cm size, is fed by line 1 to rodmill 2 for initial grinding. The rodmill and the other apparatus described herein are conventional. The product from rodmill 2 is passed by line 3 for further grinding in ball mill 4 and the ground product is then passed by line 5 to cyclone 6. Prior to introduction into cyclone 6 overflow material from the magnetic concentrate thickener from line 20 and the middlings thickener overflow from line 7 are combined with the ground product from the ball mill for introduction into cyclone 6. Underflow comprising oversize feed is withdrawn by line 9 from the cyclone 6 and recycled to line 3 for regrinding in the ball mill 4.

The overflow from cyclone 6 is removed by line 8 and passed to selective flocculation 10 where slimes are withdrawn at line 11. The resulting underflow is passed by line 12 to flotation 13 conducted in the conventional manner with roughing, cleaning and scavenging stages, and the concentrate from the flotation is removed by line 14.

At this point, the flotation tailings are recovered and removed by line 15 and passed to the WHIMS apparatus for wet high-intensity magnetic separation in magnetic separator 16. The magnetic separation is conducted as described herein and final tailings are removed by line 17. The concentrate from the magnetic separator is removed by line 18 and passed to thickener 19 where overflow is removed and recycled to the cyclone 6. The underflow from thickener 19 is recycled to flotation 13. Therefore, as exemplified in this drawing, the flotation tailings are passed to wet high-intensity magnetic separation to achieve increased iron recovery.

Specific examples of the present invention will now be set forth. Unless otherwise indicated, all percentages are by weight and all percentage weights are based upon the mill feed ore. Furthermore, unless otherwise indicated, all processing steps are conducted at ambient temperature and pressure. It is to be understood that these examples are merely illustrative and are in no way to be interpreted as limiting the scope of the invention.

EXAMPLE I

Beginning with a tailing produced by the flotation beneficiation process set forth in the flow sheet of FIG. 1, the tailing is fed to a high-gradient carousel-type separator. Cationic gangue flotation is the type of flotation used in the beneficiation process. The carousel-type separator has stainless steel wool as the ferromagnetic matrix thereof. The air-gap magnetic field produced by the separator is 6 kG, directed parallel to the direction of slurry flow.

Wet high-intensity magnetic separation (WHIMS), according to the present invention, is carried out, and there is produced a nonmagnetic tailing containing 10.2% of the total iron and a magnetic concentrate containing 9.0% of the total iron. The starting material tailing contained 19.2% of the total iron. Thus, the magnetic separator scavenged 46.9% of the iron from the flotation tailing. Additionally, prior to the WHIMS, the starting material tailing accounted for 54.9% of the total weight, and after the magnetic separation, the nonmagnetic tailing accounted for 41.1% of the total weight. Accordingly, the WHIMS scavenged 25.1% of the weight from the flotation tailing. Furthermore, the starting material tailing had an assay of 12.7% iron and the nonmagnetic tailing had an assay of 9.0% iron.

The iron recovery process, according to the present invention, is then carried out. The magnetic concentrate is fed to a thickener; the solids content of the concentrate is increased in the thickener, and the thickener underflow is fed to a flotation cell. This flotation cell is the scavenger flotation cell used in the original flotation system, and there is carried out in this flotation cell a cationic gangue flotation. The iron recovery process yields a concentrate containing 81.5% of the total iron and having an assay of 63.5% iron. This concentrate accounts for 46.5% of the total weight of the feed ore.

By comparison, the concentrate produced by the flotation beneficiation process of the prior art (no WHIM scavenging), contained 72% of the total iron. Thus, the present invention produced an increased iron recovery of 9.5%. The concentrate produced by prior art also had an assay of 63.5% iron.

The feed ore used in this Example contained 36.2% iron.

EXAMPLE II

Beginning with a tailing produced by the flotation beneficiation process set forth in the flow sheet of FIG. 1, the tailing is fed to the high-gradient carousel-type separator used in Example I. Wet high-intensity magnetic separation, according to the present invention, is carried out in the matter disclosed in Example I. There is produced a magnetic concentrate containing 4.1% of the total iron. The starting material tailing contained 8.1% of the total iron. Thus, the WHIMS scavenged 51.8% of the iron from the flotation tailing.

Next, the iron recovery process, according to the present invention, is carried out in the manner disclosed in Example I to produce a concentrate containing 86.5% of the total iron and having an assay of 63.6% iron and 4.4% silica.

By comparison, the concentrate produced by the flotation beneficiation process of the prior art (no WHIM scavenging) contained 84.4% of the total iron and had an assay of 63.5% iron and 4.3% silica. Further details concerning this Example are set forth in Table 1.

EXAMPLE III

Figure 2:
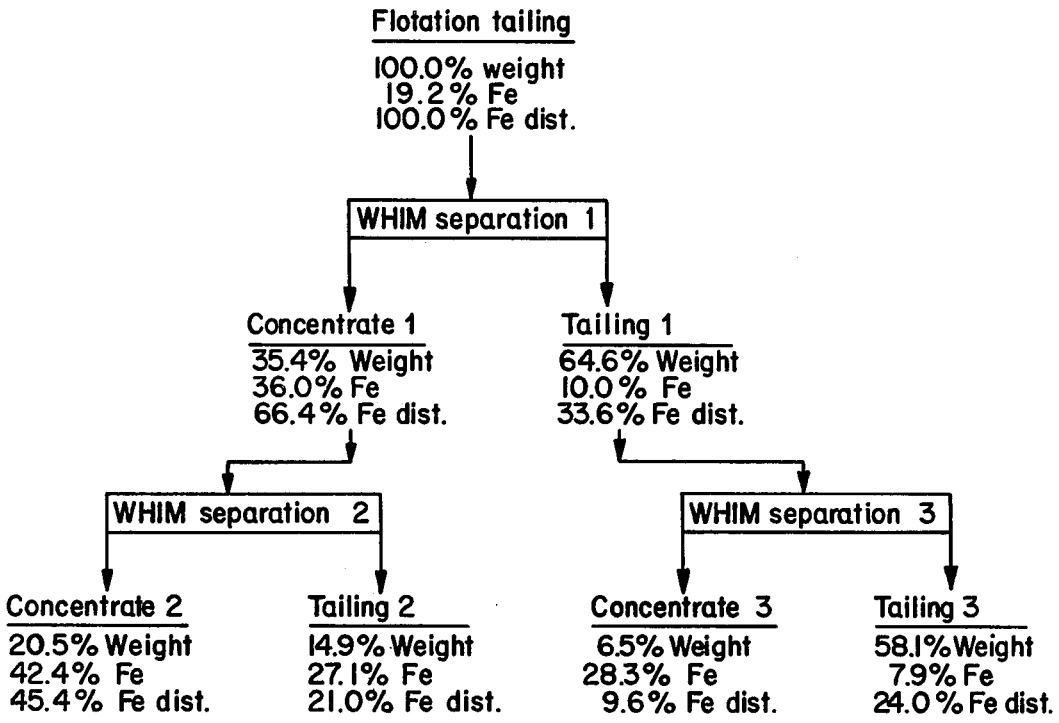
FIG. 2 depicts a flow sheet using multistage wet high-intensity magnetic (WHIM) scavenging of flotation tailing, as detailed in Example III.

This example is exemplified in FIG. 2 of the drawings. It illustrates multistage magnetic scavenging.

Beginning with 53 g of flotation tailing containing 19.2% iron, the tailing is fed to a laboratory wet high-intensity magnetic separator having stainless steel wool as the ferromagnetic matrix. Cationic gangue flotation is the type of flotation used in the flotation beneficiation process used to produce the tailing.

TABLE 1

| Sample | No WHIM Scavenging | WHIM Scavening |
|---|---|---|
| | percent | |
| Feed | | |
| Fe | 36.1 | 35.5 |
| Concentrate | | |
| Fe | 63.5 | 63.6 |
| $SiO_2$ | 4.3 | 4.4 |
| Weight | 48.0 | 48.3 |
| Fe dist. | 84.4 | 86.5 |
| Slime | | |
| Fe | 19.8 | 18.9 |
| Weight | 12.0 | 17.9 |
| Fe dist. | 6.5 | 9.5 |
| Flotation tailing | | |
| Fe | 8.0 | [1] |
| Weight | 40.0 | 6.9 |
| Fe dist. | 9.1 | 41.9 |
| | | 8.1 |
| WHIM tailing | | |
| Fe | — | 4.1 |
| Weight | — | 33.8 |
| Fe dist. | — | 4.0 |

[1] Feed to WHIM separator

A 10 kG transverse magnetic field is applied by the separator to the tailing. WHIM separation 1 reduces the iron assay of the tailing from 19.2 to 10.0%. Furthermore, the WHIMS scavenged 66.4% of the iron from the tailing.

Next, the magnetic concentrate ("Concentrate 1") produced by this first scavenging step is fed to the magnetic separator (WHIM separation 2). This results in the grade of the concentrate being increased from 36.0 to 42.4% iron.

Finally, the nonmagnetic tailing ("Tailing 1") produced by the first scavenging step is fed to the magnetic separator (WHIM separation 3). This further decreases the iron content in the tailing from 10.0 to 7.9% iron. Other results are set forth in the flow sheet of FIG. 2.

The intermediate-grade products, "Tailing 2" and "Concentrate 3", could be combined and recycled as a middling product to WHIM separation 1. Alternatively, if a high-grade magnetic concentrate is desired, "Tailing 1" and "Tailing 2" could be combined as the final tailing. As another alternative, if a low-iron tailing is desired, "Concentrate 1" and "Concentrate 3" could be combined as the magnetic concentrate.

INDUSTRIAL APPLICABILITY

This process can be used to increase the iron recovery in operating and future flotation beneficiation plants and will permit these plants to yield a more uniform output by leveling off the variations in the flotation process due to changes in ore and plant water characteristics. The recovery of iron from the oxidized taconites of Minnesota's Western Mesabi Range can be increased by using this process. Additionally, this process can be put into use at existing iron ore flotation plants in Michigan, such as the Tilden Mine, which currently recovers approximately 70% of the iron in the feed ore.

We claim:

1. A process for recovery of iron from iron ore consisting essentially of subjecting the ore to cationic gangue flotation to produce a flotation concentrate as underflow and flotation tailings as overflow, and subsequently scavenging iron from said tailings by means of a wet high-intensity magnetic separator, whereby a magnetic concentrate of increased iron content and a magnetic tailings of reduced iron content are obtained.

2. The process of claim 1 wherein said magnetic separator has a ferromagnetic matrix.

3. The process of claim 2 wherein said magnetic separator is selected from the group consisting of a high-gradient carousel-type separator, a cyclic high-intensity separator, and a rotor high-intensity separator.

4. The process of claim 2 wherein said magnetic separator is a high-gradient carousel-type separator.

5. The process of claim 1 wherein said magnetic separator produces an air-gap magnetic field strength in the range of from about 2 kG to about 100 kG.

6. The process of claim 5 wherein said field strength is about 5 kG to 10 kG.

7. The process of claim 1 wherein the orientation of the magnetic field produced by said magnetic separator is transverse or parallel to the tailings.

8. The process of claim 1 wherein said flotation step is preceded by a selective flocculation step.

9. The process of claim 1 comprising the further step of scavenging the magnetic tailings reduced in iron content with a wet high-intensity magnetic separator, whereby said tailings are further reduced in iron content.

10. The process of claim 1 comprising the further step of treating said magnetic concentrate with a wet high-intensity magnetic separator, whereby there is obtained a magnetic concentrate of higher grade than said magnetic concentrate.

11. The process of claim 1 including the additional step of feeding said magnetic concentrate to a flotation system, and carrying out additional flotation to further increase the recovery of iron.

12. The process of claim 11 wherein said magnetic concentrate is fed to a flotation cell of the flotation system used in the primary flotation beneficiation process.

13. The process of claim 11 wherein cationic gangue flotation is carried out in the flotation system.

14. The process of claim 11 further comprising the step of feeding the magnetic concentrate to a thickener prior to feeding said concentrate to the flotation system, whereby the solids content of said concentrate is increased.

15. The process of claim 16 further comprising the step of grinding the thickened concentrate prior to said concentrate being fed to the flotation system, whereby particles in said concentrate are ground to liberation.

* * * * *